United States Patent [19]

Scott, Jr.

[11] 4,414,877

[45] Nov. 15, 1983

[54] MUSICAL DOOR CHIME PREFERABLY ALSO COMBINED WITH A CLOCK FOR ANNUNCIATING THE TIME

[75] Inventor: Waller M. Scott, Jr., West Chester, Ohio

[73] Assignee: Scovill Inc., Waterbury, Conn.

[21] Appl. No.: 334,321

[22] Filed: Dec. 24, 1981

Related U.S. Application Data

[62] Division of Ser. No. 100,163, Dec. 4, 1979, Pat. No. 4,326,276.

[51] Int. Cl.[3] ..... G10H 3/00; G10H 1/02

[52] U.S. Cl. ..... 84/1.13; 84/1.26

[58] Field of Search ..... 84/1.01, 1.03, 1.13, 84/1.24, 1.26

[56] References Cited

U.S. PATENT DOCUMENTS

| | | | |
|---|---|---|---|
| 4,010,667 | 3/1977 | Kmepkamp | 84/1.03 |
| 4,014,238 | 3/1977 | Southard | 84/1.13 |
| 4,161,128 | 7/1979 | Yamada et al. | 84/1.26 |

*Primary Examiner*—Vit W. Miska

*Attorney, Agent, or Firm*—Wood, Herron & Evans

[57] ABSTRACT

A musical door chime which includes a repertoire of musical tunes one of which is played when a door pushbutton, preferably the front door pushbutton, is actuated. The musical tune which is played may be selected by means of a keyboard connected to a microprocessor. Digitally encoded representations of the notes of each musical tune are stored in a memory. Each digitally encoded musical note is read from memory by the microprocessor and converted by the microprocessor into a squarewave having the frequency and the duration of the note. The microprocessor is connected to a note strike and decay circuit which is preferably connected in series with an active audio filter circuit for translating the squarewave into a sinusoidal output for energizing a loudspeaker so that relatively high quality audible tones are heard when the musical tune is played. Preferably, a two-note musical tune is played when a rear door pushbutton is actuated, and a fixed single musical note is played when a side door pushbutton is actuated.

5 Claims, 4 Drawing Figures

SCOVILL 105-N TRANSFORMER
115V 60Hz
VDR1
1N4002
MC78M05 5V REG.
MC78M15 15V REG.
741 OPAMP
LM380
MPSA70
MPSA20
MPSA13
DOOR SPKR.
EXT. SPKRS.
SPK. 8Ω
I-COM. VOL.
I-COM. MUTING
VOL.

MUSICAL DOOR CHIME PREFERABLY ALSO COMBINED WITH A CLOCK FOR ANNUNCIATING THE TIME

This is a division, of application Ser. No. 100,163, filed Dec. 4, 1979, U.S. Pat. No. 4,326,276.

BACKGROUND OF THE INVENTION

The invention relates to audible frequency tone generation and more particularly to generation of different audible frequency tones which are played for announcing someone at a door, for annunciating the time of day, for paging employees at a department store, and so forth. Specifically, the invention is directed to generation of audible frequency tones having good tonal quality from digitally encoded information and to a musical door chime preferably also combined with a clock for both announcing the presence of someone at a door and for annunciating the time of day.

There is a substantial amount of prior art in the field of electronic audible frequency tone generation, especially in the area of electronic organs. Sophisticated electronic circuits are provided in some electronic organs for not only playing individual musical notes in response to actuation of individual keys in the keyboard, but also for generating chords comprising a plurality of musical notes or even a rhythm pattern in response to actuation of an additional key or keys. Generally speaking, however, electronic organ audible frequency tone generating circuits are too expensive to be considered for a commercially feasible musical door chime.

Recently, however, less sophisticated electronic audible frequency tone generating circuits have been proposed for musical door chimes. U.S. Pat. Nos. 3,878,750 and 4,043,240, for example, disclose electronic audible frequency tone generating circuits for playing a musical tune when a means, such as a door pushbutton, is actuated. The musical door chimes disclosed by these patents include a memory for storing digitally encoded representations of each note of a musical tune and hard-wired digital circuitry connected to the memory for addressing and decoding each musical note for generating a squarewave having the frequency and the duration of the note. The generated squarewave energizes a loudspeaker for playing the musical note.

There are several disadvantages to the musical door chimes disclosed by U.S. Pat. Nos. 3,878,750 and 4,043,240. In the first place, in order to generate the frequencies of some musical notes with accuracy, an additional frequency correction circuit must be included which adds to the complexity of the hard-wired digital circuitry and to the cost. In the second place, even if a frequency correction circuit is included, as shown in U.S. Pat. No. 4,043,240, a squarewave is used for energizing a loudspeaker which results in poor tonal quality.

SUMMARY OF THE INVENTION

The invention provides a musical door chime for playing one musical tune from a repertoire when a door pushbutton, preferably the front door pushbutton, is actuated. The musical tune which is played may be selected by means of a keyboard connected to a microprocessor.

Digitally encoded representations of the notes of each musical tune are stored in a memory which is preferably a read-only memory. Each digitally encoded musical note is read from memory by the microprocessor and converted by the microprocessor using a timed-loop tone generation method into a squarewave having the frequency and duration of the musical note. The microprocessor is connected to a note strike and decay circuit which is preferably connected in series with an active audio filter circuit for translating the squarewave into a sinusoidal output for energizing a loudspeaker so that relatively high quality audible frequency tones are heard when the musical tune is played. Preferably, a two-note musical tune is played when a rear door pushbutton is actuated, and a fixed single musical note is played when a side door pushbutton is actuated, too.

The musical door chime is preferably also combined with a clock. The microprocessor is connected to a visual display for indicating the time of day. The time is preferably annunciated every quarter hour by means of musical notes. An hour strike is also played.

The microprocessor generates a swept frequency tone for the hour strike using a modified timed-loop tone generation method. The swept frequency tone comprises a frequency-multiplexed squarewave generated by the microprocessor including sequential cycles of different frequencies, preferably each of increasing frequency. The audible frequency tone of such a waveform is that of a multiple output of several frequencies combines or mixed together. By proper selection of frequencies and frequency steps, the sound created by the striking mechanism of an old mantle-type clock can be simulated, for example.

The keyboard connected to the microprocessor also preferably serves for controlling the microprocessor in other ways than selecting the musical tune to be played when the front door pushbutton is actuated. The keyboard can also be used for testing the musical door chime and for selectively inhibiting the musical door chime. When the musical door chime is also combined with a clock for annunciating the time of day, the keyboard can be used for initially entering the correct time of day, for selectively inhibiting annunciation of the time, and for selecting the times that are annunciated during each hour.

The present invention provides a microprocessor-controlled musical door chime which has significant advantages over hard-wired digital circuit musical door chimes in terms of facilitating correction of frequencies for some of the musical notes. Furthermore, the squarewave generated by the microprocessor is shaped by the note strike and decay circuit and the active audio filter circuit so that the audible frequency tones which are heard are much more pleasing to the ear than the audible frequency tones played by other known musical door chimes. The microprocessor can also be used for driving a clock and for generating audible frequency tones for annunciating the time of day. Furthermore, a swept frequency tone is generated by frequency multiplexing for producing audible tones which are not available with known musical door chimes.

BRIEF DESCRIPTION OF THE DRAWING

The above and other features and the concomitant advantages of the musical door chime and time annunciator of the invention will be better understood by those of skill in the art after a consideration of the description which appears below in connection with the accompanying drawing. In the drawing.

GENERAL DESCRIPTION

Figure 1:
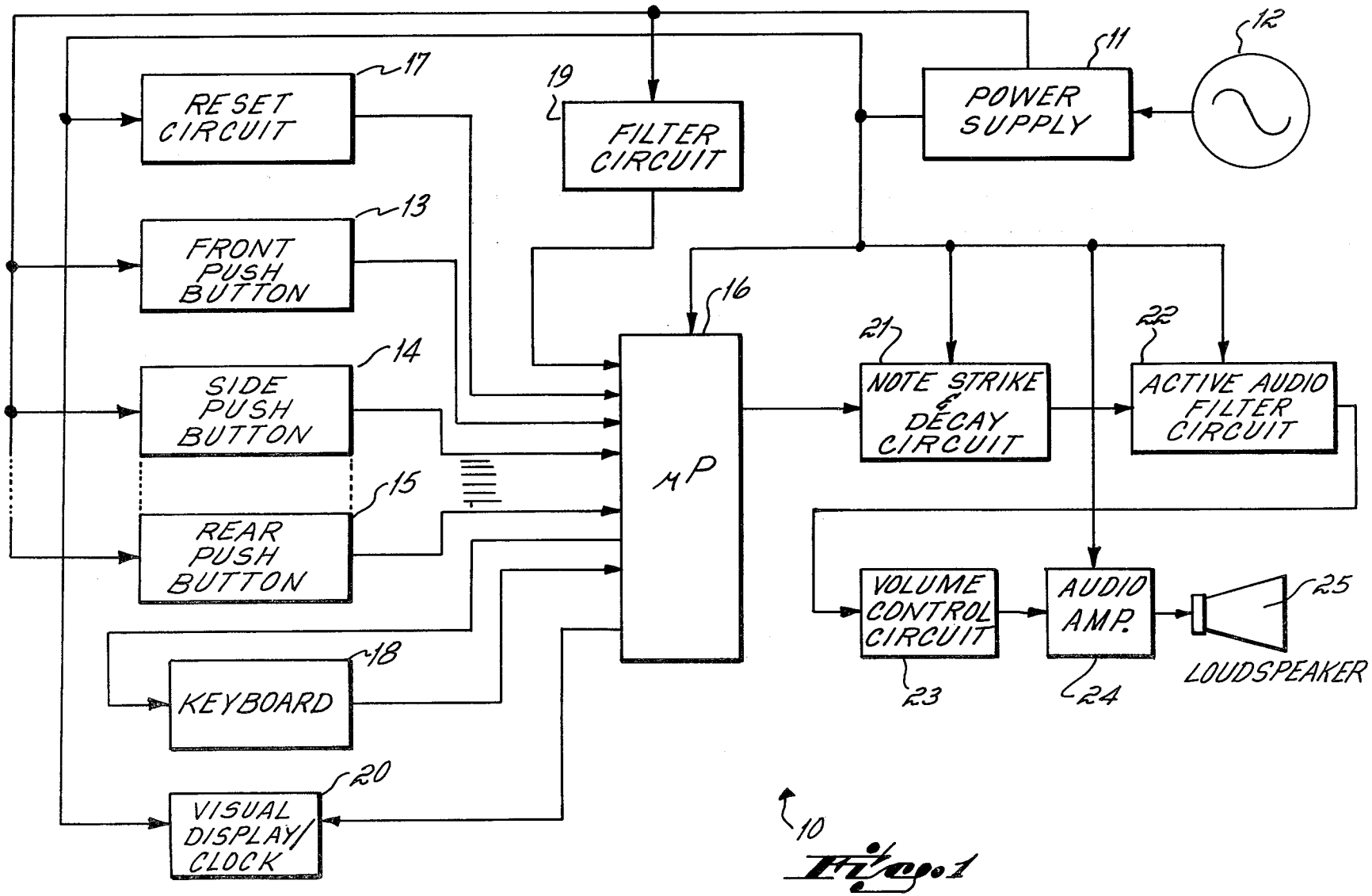
FIG. 1 is a block diagram of a preferred embodiment for the musical door chime and time annunciator of the invention.

A preferred embodiment of the musical door chime and time annunciator of the invention is designated generally by the reference numeral 10 in the block diagram of FIG. 1. As shown in FIG. 1, a power supply 11 is preferably included. The input of power supply 11 is preferably connected to alternating current power source 12, such as the 115 volts, 60 Hz. alternating current available at an electrical outlet in a typical home.

One output of power supply 11 is connected to the input of each of a set of door pushbuttons, such as front door pushbutton 13, side door pushbutton 14, and rear door pushbutton 15. The output of each of the door pushbuttons 13, 14, and 15 is in turn connected to an input of a microprocessor 16.

Another output of power supply 11 is connected to the input of a reset circuit 17 whose output is connected to an input of microprocessor 16. Reset circuit 17 resets microprocessor 16 in response to connection of power supply 11 to power source 12 when musical door chime and time annunciator 10 is installed or when power is restored after a power outage such as due to a storm.

A keyboard 18 is connected to microprocessor 16 and includes keys for entry of codes for controlling microprocessor 16. As will be explained in more detail later, keyboard 18 may be used for selecting the musical tune which is to be played when one of the door pushbuttons 13, 14, or 15 is actuated, for testing the musical door chime, for selectively inhibiting the musical door chime, for initially entering the correct time of day, for selectively inhibiting annunciation of the time, and for selecting the times that are annunciated during each hour.

A filter circuit 19 is included which has an input connected to power supply 11 and output connected to microprocessor 16. Filter circuit 19 is for supplying a frequency reference, such as 60 Hz., to an internal zero crossing circuit within microprocessor 16 which in turn is connected to a buffer. As will be explained later, the duration that each musical note is played is based on the 60 Hz. frequency reference. Also, microprocessor 16 preferably controls a visual display 20 connected to power supply 11 based on the 60 Hz. frequency reference for indicating the time of day. Preferably, visual display 20 is also used for displaying the musical tune code which is initially entered by means of keyboard 18 as well as for displaying the correct time of day which is initially entered by means of keyboard 18.

Digitally encoded representations of the notes of the musical tune which is played when one of the door pushbuttons 13, 14, or 15 is actuated or when the time is annunciated as well as the hour strike for clock 20 are stored in a memory, preferably a read-only memory, included in microprocessor 16. Each musical note is stored in the form of an 8-bit word which is converted by microprocessor 16 into a squarewave having a frequency and a duration corresponding to the frequency and duration of the note. The squarewave appears at the output of microprocessor 16.

The output of microprocessor 16 is connected to the input of a note strike and decay circuit 21 which also has an input connected to power supply 11. Note strike and decay circuit 21 is controlled by mircoprocessor 16 for providing a decay envelope for the squarewave generated by microprocessor 16.

The output of note strike and decay circuit 21 is connected in turn to the input of an active audio filter circuit 22 also having an input connected to power supply 11. Active audio filter circuit 22 is for shaping the waveform within the decay envelope which appears at the output of note strike and decay circuit 21 for providing a sinusoidal waveform.

The output of active audio filter circuit 22 is connected to the input of a volume control circuit 23 whose output is connected to the input of an audio amplifier 24 which also has an input connected to power supply 11. Volume control circuit 23 is for controlling the amplitude of the output of audio amplifier 24.

Finally, output of audio amplifier 24 is connected to a loudspeaker 25. Audio amplifier 24 is for energizing loudspeaker 25 for playing the musical notes.

DETAILED DESCRIPTION

Musical door chime and time annunciator 10 preferably includes a repertoire of 25 musical tunes one of which is played when front door pushbutton 13 is actuated, a fixed two-note musical tune which is played when rear door pushbutton 15 is actuated, and a fixed single musical note which is played when side door pushbutton 14 is actuated. The tune which is played when the front door pushbutton is actuated may be selected by means of keyboard 18. Preferably, an electronic clock is included and the time is annunciated on the quarter hour, half-hour, three-quarter hour and/or hour and the hours are struck as selected by means of keyboard 18.

Figure 4A:
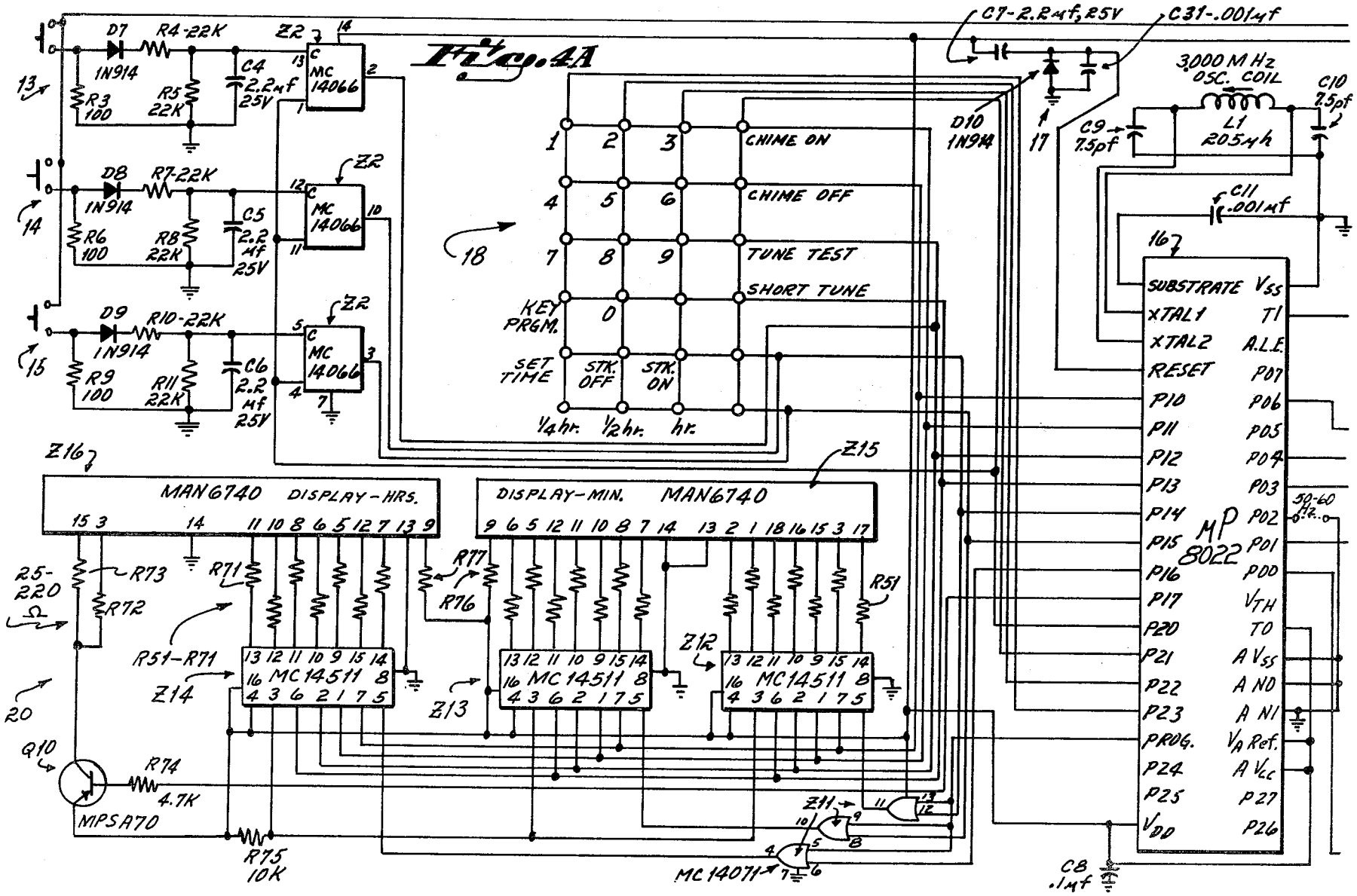
FIG. 4 is a schematic circuit drawing for the musical door chime and time annunciator shown in the block diagram of FIG. 1.
Figure 4B:
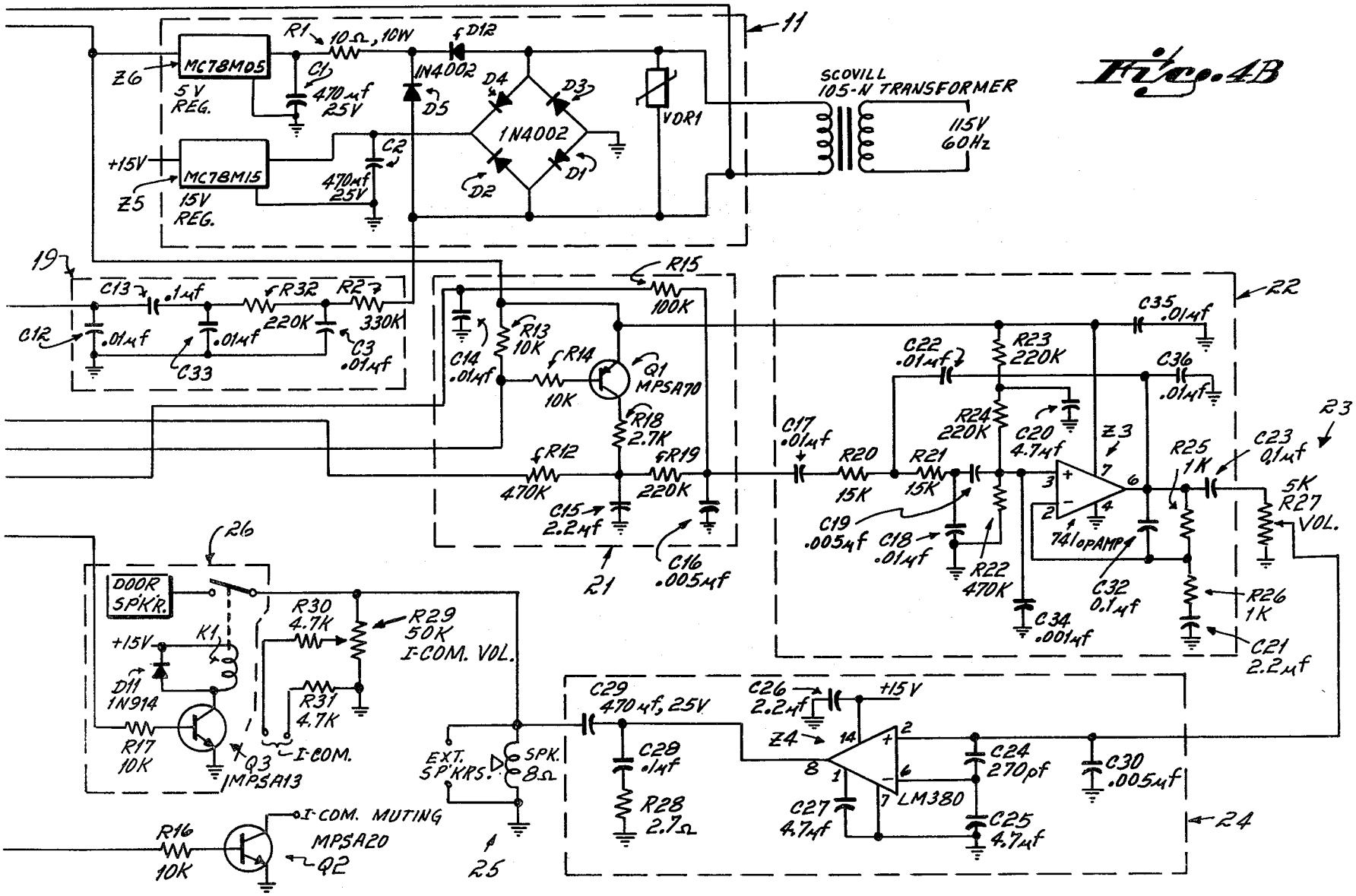

As shown in FIG. 4, musical door chime and time annunciator 10 is powered by a 115 volt, 60 Hz. alternating current power source connected to power supply circuit 11. Power supply circuit 11 includes a #105-N step-down transformer which transforms the 115 VAC connected across the primary winding to 16 VAC which appears across the secondary winding. The secondary winding of the transformer is connected to a full-wave rectifier and additional circuitry for supplying a requlated five volts direct current as well as a regulated 15 volts direct current for energizing the remainder of the circuitry.

Reset circuit 17 is connected to the regulated five volts direct current. The reset circuit generates a reset pulse for resetting microprocessor 16 when the alternating current power source is first connected to power supply circuit 11.

The secondary winding of the transformer is also connected to each of the door pushbuttons 13, 14, and 15. Each door pushbutton is preferably a lighted pushbutton which requires light bulb resistors R3, R6, and R9. Each door pushbutton interfaces with microprocessor 16 through a digital transmission gate Z2.

Microprocessor 16 is preferably an 8022 available from Intel Corporation of Santa Clara, Calif. However, the microprocessor may be any one of the Intel MCS-48 family of single chip microcomputers or another type of microprocessor.

Keyboard 18 is included which comprises a matrix of vertical and horizontal conductors. When a particular key in the keyboard is depressed, a certain vertical wire contacts a certain horizontal wire. The keyboard is connected to microprocessor 16.

The secondary winding of the transformer is also connected to filter circuit 19 which is in turn connected to a zero crossing detector included in microprocessor 16 for supplying a 60 Hz. frequency reference. An LC tank circuit is connected to internal oscillator circuitry in microprocessor 16 for supplying a frequency reference of 3 megahertz.

Microprocessor 16 interfaces with note strike and decay circuit 21 which is in turn connected to active audio filter circuit 22 for shaping the squarewave for each musical note generated by the microprocessor. Active audio filter circuit 22 is connected by volume control circuit 23 to audio amplifier 24 which is in turn connected to loudspeaker 25 for playing the generated musical notes. As shown in FIG. 4, audio amplifier 24 may also be connected to an extension loudspeaker and/or thorugh an intercom system volume control circuit and audio amplifier to intercom system loudspeakers for playing the generated musical notes throughout a house. The muting circuitry of the intercom system may also be connected to the microprocessor so that the intercom music source is silenced when the generated musical notes are played. Microprocessor 16 is also preferably connected to an optional relay kit 26 for connecting the audio amplifier to a loudspeaker at the front door so that the person who actuates the front door pushbutton can hear the musical tune which is played.

Preferably, if a clock is provided, the clock includes display modules Z15 and Z16. Display modules Z15 and Z16 interface with and are controlled by microprocessor 16 through binary-coded-decimal-to-seven-segment decoder drivers with latches Z12–Z14.

When the alternating current power source is first connected to power supply circuit 11 or when power is restored after a power failure, such as due to a storm, reset circuit 17 resets microprocessor 16. Microprocessor 16 includes a read-only memory for storing a repertoire of 25 musical tunes, a two-note musical tune, and a musical note. After reset of microprocessor 16, if front door pushbutton 13 is actuated, a preselected musical tune is played. If rear door pushbutton 15 is actuated, the two-note musical tune is played. If side door pushbutton 15 is actuated, the single musical note is played.

The homeowner can select another musical tune stored in the read-only memory by means of keyboard 18. The homeowner merely enters a code which corresponds to the musical tune that he wants played when front door pushbutton 13 is actuated.

As shown in FIG. 4, output ports P10–P15 of microprocessor 16 are connected to the horizontal conductors of keyboard 18 while input ports P20–P23 of the microprocessor are connected to the vertical conductors of the keyboard. As each output port P10–P15 is sequentially pulsed for strobing the horizontal conductors of keyboard 18, each input port P20–P23 is sequentially enabled for scanning the vertical conductors of the keyboard.

In order to select a musical tune, the homeowner first depresses the PROGRAM key, then enters a code corresponding to the musical tune that he wants played when front door pushbutton 13 is actuated, and finally depresses the TUNE TEST key for loading the code for the selected musical tune into microprocessor 16. The musical tune is preferably automatically played when the TUNE TEST key is actuated so that the homeowner can verify that he actually selected the desired musical tune. If the homeowner desires only a truncated version of the musical tune that he wants played when the front door pushbutton is actuated, he first depresses the PROGRAM key, then enters a code corresponding to the musical tune that he wants played when front door pushbutton 13 is actuated, next depresses the SHORT TUNE key, and finally depresses the TUNE TEST key for loading the code for the selected musical tune into microprocessor 16. The keyboard also includes CHIME ON and CHIME OFF keys for respectively enabling and inhibiting the playing of the musical tune when front door pushbutton 13 is actuated, the playing of the two-note musical tune when rear door pushbutton 15 is actuated, and the playing of the single musical note when side door pushbutton 14 is actuated.

Output ports P12, P14, and P15 of microprocessor 15 are connected to the outputs of digital transmission gates Z2 for sequentially strobing front door pushbutton 13, side door pushbutton 14, and rear door pushbutton 15 while input port P20 of microprocessor 16 is connected to the inputs of the digital transmission gates for scanning the front door pushbutton, the side door pushbutton, and the rear door pushbutton. When front door pushbutton 13 is actuated, a musical tune automatically preselected when the microprocessor is reset or selected by the homeowner by means of keyboard 18 is played. When rear door pushbutton 15 is actuated, the fixed two-note musical tune is played. When side door pushbutton 14 is actuated, the fixed single musical note is played.

Initial reset of microprocessor 16 or entry by the homeowner of a code for a selected musical tune provides an initial address for a binary word in the read-only memory which is accessed and loaded into random access memory if front door pushbutton 13 is actuated. The binary word includes various control codes, including a control code which sets the tempo for the musical tune. The address is then incremented to the address of the first musical note which is to be played, and the microprocessor accesses and loads into random access memory the binary word for the first musical note. The binary word for the first musical note includes a frequency code and a duration code for the musical note. After the first musical note is played the address is again incremented, and the binary word for the next musical note, which includes a frequency code and a duration code for the second musical note is accessed and loaded into random access memory and played, and so forth until the last musical note of the musical tune is played. The binary word which follows the last musical note of the musical tune is a control code to stop.

As each binary word for a musical note is accessed and loaded into random access memory, the codes for the frequency and duration of the musical note are used to access respective frequency and duration look-up tables stored in read-only memory. Actually, there are two duration look-up tables in read-only memory, and the particular duration look-up table which is accessed is determined by the control code for the tempo included in the initial binary word which is addressed.

Based on the frequency code in the binary word for the musical note which is to be played, the frequency look-up table is accessed and a binary coded number which represents the frequency of the musical note is read out of the look-up table and loaded into random access memory. Similarly, based on the duration code for the musical note which is to be played, the duration table determined by the tempo control code is accessed and a binary coded number which represents the duration of the musical note is read out of the look-up table and loaded into random access memory.

Figure 2:
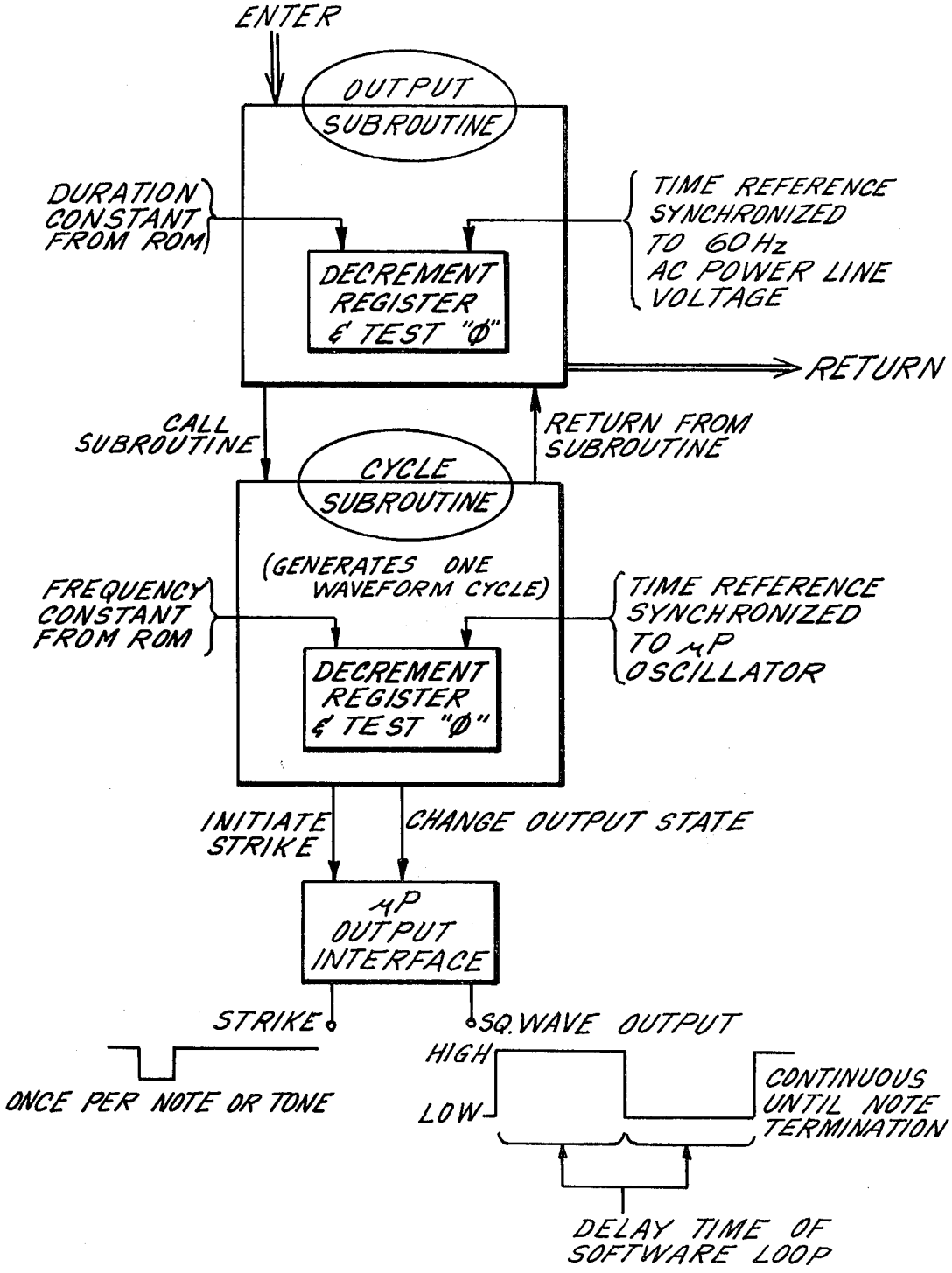
FIG. 2 is a flow chart for a conventional timed-loop tone generation method for converting a digitally encoded representation of a musical note into a squarewave having the frequency and duration of the note.

The frequency number read out of the frequency look-up table is used in a conventional timed-loop tone generation subroutine illustrated by the flow chart shown in FIG. 2 for generating the frequency of the musical note which is to be played. the timed-loop tone generation method is treated at length by Hal Chamberlin, "A Sampling of Techniques for Computer Performance of Music" in the September, 1977 issue of *Byte Magazine* incorporated by reference herein.

Basically, the method of tone generation involves a timed software delay loop in the microprocessor program. The timed-loop operates in a manner allowing incremental adjustment of a time delay. The increments of adjustment are fixed at multiples of the instruction cycle time of the microprocessor (which is directly related to the frequency of the microprocessor clock oscillator). The timed-loop is used to control the repetitive switching of a microprocessor output between high and low states, thus forming a squarewave output. This squarewave is used as the audio output tone for further frequency shaping by the connected analog circuitry.

The delays are generated for different output frequencies through software control of internal microprocessor registers and up/down counters. Basically, a specifically chosen constant (for each frequency) is preset into an 8-bit register. This register is then successively decremented in steps of 1 and tested for zero status after each decrementing operation. The decrementing and testing operation requires a fixed, known amount of time (20 microseconds in the case of the Intel 8022 with Fosc=3.00 MHz.) Thus, by varying the preset constant, the amount of time required to count the register down to zero can be varied. The preset delay is used to adjust the length of the ½ period of a squarewave as shown in the flow chart in FIG. 2.

The decrementing and testing operation is cycled through a number of times equal to the number which is obtained from the frequency look-up table. After a total time equal to the number obtained from the frequency look-up table multiplied by the approximate 20-microsecond execution time for the decrementing and testing operation based on the three megahertz frequency reference, microprocessor 16 pulses the gate of an open drain field effect transistor (FET) at output port P03 of the microprocessor. Consequently, output port P03 of the microprocessor transposes from a low state to a high state at a frequency of approximately once every 20 microseconds mulitiplied by the number obtained from the frequency look-up table with a 50% duty cycle. In some cases, the tone generation subroutine must execute a frequency correction by altering the period of the pulses which are fed to the open drain FET at output port P03 of the microprocessor so that the duty cycle of the high state and low state at output port P03 is adjusted for more accurately generating the frequency of the musical note which is to be played. Frequency correction is accomplished by making a further adjustment in the length of one of the ½ periods of the squarewave in increments of 10 microseconds, thereby providing 10 microsecond resolution for the periods of the musical notes.

The microprocessor will repeatedly execute the timed-loop tone generation subroutine for a period of time determined by the duration number read out of the duration look-up table. The duration number defines one-of-sixteen duration intervals. The duration number read out of the duration look-up table is used in a timed-loop duration subroutine for fixing the duration of the musical note which is to be played.

That is, as shown in FIG. 2, upon initiating the generation of an output squarewave using the timed-loop tone generation subroutine, a parallel timed-loop is also initiated. This loop determines the duration of the squarewave output. The parallel timed-loop is not decremented in step with the microprocessor clock oscillator but in a similar fashion using an external timing reference (in this case, the 60 Hz. AC powerline voltage). Preselected constants relating to how many 60 Hz. pulses should be counted before terminating the squarewave are chosen to provide the desired duration of output tone at the previously selected frequency of the musical note.

Microprocessor 16 cycles through the duration subroutine until the number of 60 Hz. pulses supplied by the internal zero crossing detector included in the microprocessor equals the number obtained from the duration look-up table. Consequently, the duration of the musical note which is to be played is equal to the number obtained from the duration look-up table multiplied by 1/60th of a second. After the duration subroutine has been executed, the binary word for the next musical note which is to be played is addressed in read-only memory.

As a result of the tone generation and duration subroutines, the open drain FET at output port P03 of the microprocessor is pulsed at a frequency equal to the frequency of the musical note which is to be played for a duration equal to the length of time that the given musical note is to be played. The process is the same for the two-note musical tune which is played when rear door pushbutton 15 is actuated and for the single musical note which is played when side door pushbutton 14 is actuated.

At the time that each musical note is to be played, output port P04 of microprocessor 16 transposes to a low state for approximately 25 milliseconds. Consequently, a transsitor Q1 included in note strike and decay circuit 21 shown in FIG. 4 is forward-biased. As a result, a capacitor C15 is connected through a resistor R18 and the emitter-collector circuit of transistor Q1 to regulated five volts direct current and charges to approximately five volts in a relatively short time. Moreover, a low pass filter comprising a resistor R19 and a capacitor C16 is connected to capacitor C15, and, consequently, capacitor C16 begins to charge. Furthermore, a capacitor C14 is connected to capacitor C16 by a resistor R15, and, consequently, capacitor C14 begins to charge.

Capacitor C14 is connected to output port P03 of microprocessor 16. As a result, capacitor C14 is discharged whenever output port P03 of the microprocessor transposes to a low state at a frequency which depends on the timed-loop tone generation subroutine executed by the microprocessor for generating a musical note.

Capacitor C15, which initially is charged to approximately five volts, is discharged over the duration of the musical note which is to be played for producing a decay envelope. The actual shape of the decay envelope is determined by the time constant of capacitor C15 and resistors R19 and R15 and the frequency of the squarewave at output P03 of microprocessor 16. The frequency of the voltage within the envelope is determined by the musical note which is to be played, and the actual shape of the voltage within the envelope is determined by the time constant of resistor R19 and capacitor C16 and the time constant of resistor R15 and capacitor C14; that is, the shape of the voltage within the envelope is determined by the charging of capacitor C16 from capacitor C15 through resistor R19 and the discharging of capacitor C16 through resistor R15, capacitor C14, and output P03 of the microprocessor.

The rate of decay can be altered in response to the control code for the tempo included in the initial binary word which is addressed. The control code for the tempo determines whether a high state or a low state appears at output port P06 of microprocessor 16 for producing either a long or a short decay, respectively, that is, whether or not capacitor C15 is partially discharged through a resistor R12 as the musical note is played.

The voltage across capacitor C16 is coupled through a capacitor C17 to active audio filter circuit 22 which is of conventional design. Active audio filter circuit 22 shapes the waveform, actually a sawtooth waveform, within the decay envelope produced by note strike and decay circuit 21 into a sinewave.

Active audio filter circuit 22 is connected by a volume control potentiometer R27 for setting the volume to audio amplifier 24 which energizes loudspeaker 25 and any other extension loudspeakers. The output of the audio amplifier may also be connected through an intercom volume control potentiometer R29 to the intercom system audio amplifier and loudspeakers in various places around the house or to an optional relay kit loudspeaker which is energized by output port P01 of microprocessor 16 for playing the musical tune at the front door. Output port P00 of the microprocessor is connected to the muting circuit of the intercom system in order to inhibit the intercom music source when the musical door chime and time annunciator plays.

Preferably, an electronic clock is included which must be initially set by the homeowner when the power source is first connected. The homeowner first depresses the PROGRAM key in keyboard 18, then enters the correct time by means of the keys in the keyboard, and finally depresses the SET TIME key for loading the correct time into microprocessor 16.

The homeowner can cause the time to be annunciated by depressing the STRIKE ON key. After the correct time is entered, the time will be annunciated every quarter hour if the STRIKE ON key is depressed, but the homeowner can select annunciation of the time every half hour or only on the hour by depressing the ½ HR or the HR key, respectively, and can thereafter change back so that the time will be annunciated every quarter hour by depressing the ¼ HR key. The STRIKE OFF key can be depressed for silencing the annunciator.

Output ports P14–P17 of microprocessor 16 are connected to binary-coded-decimal-to-seven-segment decoder drivers with latches Z12–Z14 for enabling the decoder driver latches for initially setting the correct time and for thereafter updating the time in response to binary codes at output ports P10–P13 and a strobe pulse at output port PROG. of the microprocessor.

Microprocessor 16 executes a clock subroutine for updating the electronic clock and for annunciating the time based on the 60 Hz. frequence reference. The 60 Hz. pulses supplied by the zero crossing detector within the microprocessor are stored in a buffer which is occasionally preset by the clock subroutine. The buffer is included so that the 60 Hz. pulses supplied by the zero crossing detector are not lost and so that there is no interruption of the musical tune which is to be played when the front door or rear door pushbutton is actuated.

The clock is effectively constructed in software using the counters, registers, and random-access memory of microprocessor 16. Timing information is obtained from the 60 Hz. power source. Storage of the accumulated seconds, minutes, and hours is held in random-access memory and is output in binary codes (a digit at a time) to the visual display circuit 20. Preferably, only minutes and hours are displayed.

The passage of the following times is decoded and keyboard 18 controls whether or not a clock strike sound is played for each one:

1. Each hour on the hour
2. 15 minutes past the hour
3. 30 minutes past the hour
4. 45 minutes past the hour The sounds played for each event are as follows:

1. A distinctive clock strike tone similar to an old style mantle clock (BONG)
2. A single musical note
3. A single musical note
4. A single musical note The musical note at XX:15, XX:30, and XX:45 is generated in the same manner as described previously. As a matter of fact, the musical note is played as a "single-note" tune. The hour strike, or BONG, sound is generated by a separate software subroutine which will now be described.

The earlier description of timed-loop tone generation was directed to the generation of a single continuous tone for each musical note of a tune of several notes. Modified timed-loops are used for generating a swept frequency, tone for simulating the BONG sound. The timed-loop swept frequency tone generation method generates a squarewave comprising by way of example seven single cycles of seven different frequencies all frequency multiplexed or strung together, each of increasing frequency (decreasing period). This group of seven pulses is continuously repeated. The continuous repetition of the squarewave results in the effect of a stepped swept frequency from $F_{low}$ to $F_{high}$. This rapidly changes the frequency at which the open drain FET at output port P03 of the microporcessor is pulsed from one cycle of the timed-loop to the next for synthesizing a swept tone frequency. The sound of such a waveform with suitable choice of frequencies and frequency steps is that of a multiple output of several frequencies combined or mixed together. The sound is rich in harmonics and contains mixing products of the various fundamental frequencies. Preferably, the chosen frequency combinations when applied to note strike and decay circuit 21 and active audio filter circuit 22 and then through volume control circuit 23, audio amplifier 24 and loudspeaker 25 result in a metallic BONG sound of high harmonic content very similar to the sound created by the striking mechanism of an old style mantle clock.

The swept frequency tone is generated through use of a cycle subroutine such as the one which appears in the basic timed-loop tone generation method described earlier in connection with FIG. 2. As shown in the flow chart in FIG. 3, at the time when the sweep frequency subroutine is activated, initial constants are loaded into various registers. Then, the initial delay constant is decremented and the new value used in the cycle subroutine to generate one cycle (one high and one low) of the prescribed frequency. (The cycle subroutine always generares one cycle each time it is called, even in basic tone generation.). The sweep frequency subroutine then subtracts a constant from the present value of the delay constant resulting in a new delay constant to be used in generating the next pulse in the pulsetrain. This procedure continues until the constant is near zero. The original constant is then re-entered into the register and the squarewave begins again (low frequency pulse first followed by increasing frequency pulses).

Figure 3:
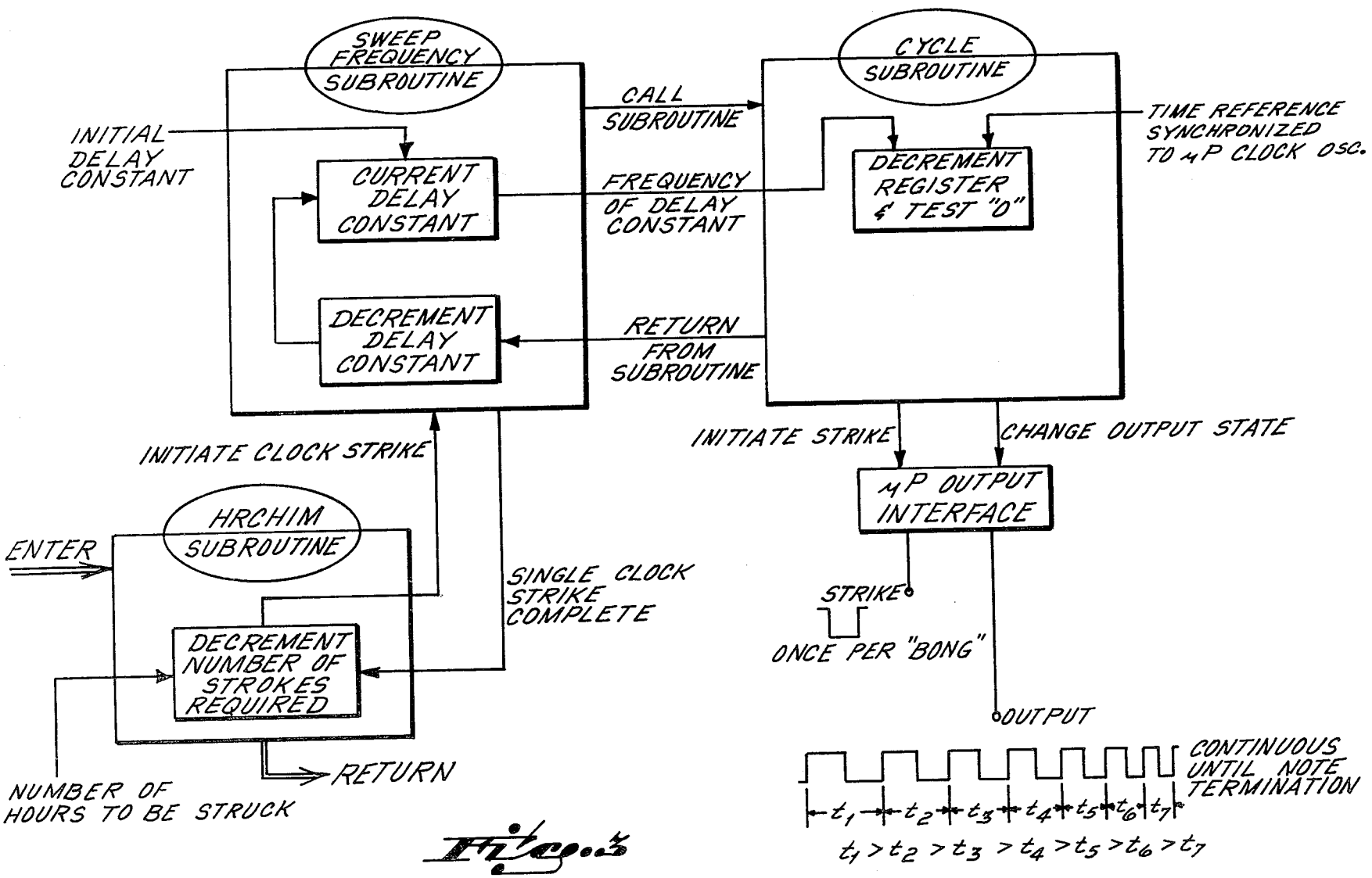
FIG. 3 is a flow chart for a modified timed-loop tone generation method in accordance with the invention for generating a swept frequency tone.

As the program continues to operate back and forth between the cycle and sweep frequency subroutines, another timed-loop is being decremented towards zero to control the duration of the output squarewave. Since the timed-loop swept frequency tone generation subroutine, in the illustrated examples, generates the hour strike tone, entry of the timed-loop swept frequency tone subroutine is through an HRCHIM (hour chime) subroutine as shown in FIG. 3 which is called by the clock subroutine hour-by-hour.

Of course, the timed-loop swept frequency tone generation subroutine, a detailed listing of which appears in Table 1 for an Intel 8022, can be used for generating swept frequency tones to create any desired mixed tone sound and not just for simulating a BONG sound. Furthermore, the generated pulsetrain may comprise a number other than seven pulses. Also, the pulses could be of decreasing frequency rather than increasing frequency. A similar subroutine could be executed by microprocessors other than the Intel 8022 or MCS-48 family.

TABLE 1

| LOC | OBJ | LINE | SOURCE STATEMENT | | |
|---|---|---|---|---|---|
| | | 2420 ; | BONG | | |
| | | 2421 ; | | | |
| | | 2422 ; | THIS ROUTINE GENERATES A SWEPT FREQUENCY SOUND | | |
| | | 2423 ; | COMPOSED OF 7 SINGLE CYCLES STRUNG TOGETHER-EACH | | |
| | | 2424 ; | OF INCREASING FREQUENCY-(DECREASING PERIOD). | | |
| | | 2425 ; | | | |
| | | 2426 ; | INPUT: 1. PROGRAM ENTRY FROM HRCHIM ROUTINE. | | |
| | | 2427 ; | | | |
| | | 2428 ; | OUTPUT: 1. CALL CYCLE | | |
| | | 2429 ; | | | |
| | | 2430 ; | MODIFIED: A, R0, R3, R6, R7 | | |
| | | 2431 ; | 2432 ; | | |
| 047F | B81C | 2433 | BONG: | MOV | R0,#BNGCTR |
| 0481 | B0FF | 2434 | | MOV | @R0,#0FFH |
| 0483 | B83C | 2435 | | MOV | R0,#STKTMP |
| 0485 | B005 | 2436 | | MOV | @R0,#05H ;ONCE PER STRIKE |
| 0487 | BE00 | 2437 | | MOV | R6,#00H ;ONCE PER STRIKE |
| 0489 | BFA5 | 2438 | | MOV | R7,#10100101B ;ONCE PER STRIKE |
| 048B | BB18 | 2439 | BONGCT: | MOV | R3,#18H |
| 048D | FB | 2440 | BONGLP: | MOV | A,R3 |
| 048E | 03FD | 2441 | | ADD | A,# - 03H |
| 0490 | AB | 2442 | | MOV | R3,A |
| 0491 | 9472 | 2443 | | CALL | CYCLE |
| 0493 | 03FD | 2444 | | ADD | A,# - 03H |
| 0495 | 968D | 2445 | | JNZ | BONGLP |
| 0497 | F0 | 2446 | | MOV | A,@R0 |
| 0498 | 07 | 2447 | | DEC | A |
| 0499 | A0 | 2448 | | MOV | @R0,A |
| 049A | 968B | 2449 | | JNZ | BONGCT |
| 049C | 10 | 2450 | | INC | @R0 |
| 049D | 2310 | 2451 | | MOV | A,#00010000B |
| 049F | 4F | 2452 | | ORL | A,R7 |
| 04A0 | AF | 2453 | | MOV | R7,A |
| 04A1 | B81C | 2454 | | MOV | R0,#BNGCTR ;#BNGCTR=LENGTH OF "BONG" |
| | | 2455 | | | ;IN NUMBER OF LOOP CYCLES. |
| 04A3 | F0 | 2456 | | MOV | A,@R0 |
| 04A4 | 07 | 2457 | | DEC | A |
| 04A5 | A0 | 2458 | | MOV | @R0,A |
| 04A6 | B83C | 2459 | | MOV | R0,#STKTMP |
| 04A8 | 968B | 2460 | JNZ | BONGCT | |
| 04AA | 83 | 2461 | | RET | |
| | | 2462 | $EJECT | | |
| | | 2463 ; | | CYCLE | |
| | | 2464 ; | | | |
| | | 2465 ; | MODIFIED: A,R2,R3,R5,R7 (R6 USED BUT NOT MODIFIED) | | |
| | | 2466 ; | | | |
| 0461 | FE | 2467 | CYCDLY: | MOV | A,R6 |
| 0462 | 00 | 2468 | | NOP | |
| 0463 | 00 | 2469 | | NOP | |
| 0464 | 07 | 2470 | | DEC | A |
| 0465 | 9668 | 2471 | | JNZ | CYDL1 |
| 0467 | 00 | 2472 | | NOP | |
| 0468 | 07 | 2473 | CYDL1: | DEC | A |
| 0469 | 966D | 2474 | | JNZ | CYDL2 |
| 046B | 00 | 2475 | | NOP | |

TABLE 1-continued

| LOC | OBJ | LINE | SOURCE STATEMENT | | |
|---|---|---|---|---|---|
| Ø46C | ØØ | 2476 | NOP | | |
| Ø46D | Ø7 | 2477 | CYDL2: | DEC | A |
| Ø46E | C66D | 2478 | | JZ | CYDL2 |
| Ø470 | 8474 | 2479 | | JMP | CYCLP |
| Ø472 | FF | 2481 | CYCLP: | MOV | A,R7 |
| Ø475 | D1 | 2482 | | XRL | A,@R1;@R1=OPCTRL=Ø8H ENABLE,ØØDISABLE |
| Ø476 | AF | 2483 | | MOV | R7,A |
| Ø477 | 9Ø | 2484 | OUTL | PØ,A | |
| Ø478 | FB | 2485 | | MOV | A,R3 |
| Ø479 | AA | 2486 | | MOV | R2,A |
| Ø47A | EA7A | 2487 | HCYCLE: | DJNZ | R2,HCYCLE |
| Ø47C | ED61 | 2488 | | DJNZ | R5,CYCDLY |
| Ø47E | 83 | 2489 | | RET | |
| | | 2490 | $EJECT | | |

Values and types for various components are shown in FIG. 4 for a preferred construction of the various circuits. However, the values and types are given by way of example only and not by way of limitation.

The keyboard-controlled, microprocessor-implemented musical door chime and time annunciator of the present invention has significant advantages in terms of facilitating correction of frequencies for some of the musical notes which are played. The microprocessor can also be used for driving a clock and for generating audible frequency tones for annunciating the time of day. Furthermore, the squarewave generated by the microprocessor is shaped by the note strike and decay circuit and the active audio filter circuit so that the audible frequency tones which are heard are much more pleasing to the ear than the audible frequency tones played by other known musical door chimes or time annunciators. Also, a swept frequency tone is generated by frequency multiplexing for producing audible tones which are not available with known musical door chimes or time annunciators.

A preferred embodiment of the musical door chime and time annunciator of the invention has been described by way of example and not by way of limitation. A combined musical door chime and time annunciator has been presented. However, by making obvious modifications, the clock can be eliminated so that only a musical door chime is provided, or the door pushbuttons can be disconnected so that only a clock and time annunciator are provided.

Other modifications may also appear to those of skill in the art which are within the spirit of this invention. Therefore, in order to ascertain the true scope of the invention, reference must be made to the appended claims.

I claim:

1. An audible frequency tone generator comprising:

a memory for storing a digitally encoded representation of the frequency and the duration of at least one musical note;

a tone generation means connected to said memory for converting said digitally encoded musical note representation for said at least one musical note into a squarewave having said frequency and said duration of said at least one musical note; and circuit means connected to said tone generation means and responsive to said at least one squarewave for playing a pleasing sound of said at least one musical note;

said circuit means including a note strike and decay circuit connected to said tone generation means, said note strike and decay circuit comprising:

(a) a first capacitor connected between a charging circuit controlled by said tone generator means and common, said charging circuit being activated for charging said first capacitor at the time said at least one musical note is to be played;

(b) a first resistor connected at one end to said first capacitor;

(c) a second capacitor connected between the other end of said first resistor and common;

(d) a second resistor connected at one end to the junction of said first resistor and second capacitor and connected at the other end to the squarewave output of said tone generation means; and (e) a third capacitor connected between the squarewave output of said tone generation means and common;

said first capacitor discharging over said duration of said at least one musical note for producing a decay envelope whose shape is determined by the time constant of said first capacitor and said first and second resistors and said frequency of said squarewave, the shape of the voltage within said decay envelope being determined by the charging of said second capacitor from said first capacitor through said first resistor and the discharging of said second capacitor through said second resistor, third capacitor, and squarewave output of said tone generation means.

2. The audible frequency tone generator in claim 1 wherein said note strike and decay circuit further comprises a third resistor connected at one end to the junction between said first capacitor and said first resistor and connected at the other end to said tone generation means and wherein said tone generation means is responsive to a first tempo control code stored in said memory for maintaining a predetermined voltage above common at the junction between said third resistor and said tone generation means for playing a normal tempo and is responsive to a second tempo control code stored in said memory for causing common to appear at the junction between said third resistor and said tone generation means for playing a faster tempo.

3. The audible frequency tone generator in claim 1 or 2 wherein said circuit means further includes:

an active audio filter circuit; and a coupling capacitor having one side connected to said note strike and decay circuit and the other side connected to said active audio filter circuit;

said active audio filter circuit for producing a sinewave.

4. A method for generating a swept audible frequency tone including the steps of:

generating timing pulses;

entering a predetermined digitally encoded initial delay value in a first register;

transferring whatever value is currently contained in the first register into a second register;

counting down the value contained in the second register by a predetermined amount in response to each timing pulse;

testing the value contained in the second register for a zero value;

generating a squarewave pulse at an output when a zero value is detected in the second register;

changing the value contained in the first register by a preset amount when the squarewave pulse appears at the output;

repeatig the transferring, counting down, testing, generating, and changing steps for a preselected time;

thereby generating a series of multiplexed pulses of different periods at the output; and applying the series of multiplexed pulses to a circuit means for playing a swept audible frequency tone.

5. The method in claim 4 further including the step of:

shaping the series of multiplexed pulses for playing a pleasing swept audible frequency tone.

* * * * *

UNITED STATES PATENT AND TRADEMARK OFFICE

CERTIFICATE OF CORRECTION

PATENT NO. : 4,414,877

DATED : November 15, 1983

INVENTOR(S) : Waller M. Scott, Jr.

It is certified that error appears in the above-identified patent and that said Letters Patent is hereby corrected as shown below:

Column 7, line 16, "the" should be -- The --.

Column 13 and 14, line 7, "Ø472" should be -- Ø474 --.

Column 13 and 14, insert between line 6 and 7 the following:

Ø472 BDØ2 2480 CYCLE: MOV R5,#Ø2H

Column 16, line 4, "repeatig" should be -- repeating --.

Signed and Sealed this

Twenty-second Day of May 1984

[SEAL]

Attest:

GERALD J. MOSSINGHOFF

Attesting Officer

Commissioner of Patents and Trademarks